United States Patent [19]

Burandt

[11] Patent Number: 4,495,902

[45] Date of Patent: Jan. 29, 1985

[54] MECHANISM FOR VARIABLY CONTROLLING AN INTERNAL COMBUSTION ENGINE VALVE

[75] Inventor: Corliss O. Burandt, Plymouth, Minn.

[73] Assignee: Investment Rarities, Incorporated, Minneapolis, Minn.

[21] Appl. No.: 491,819

[22] Filed: May 5, 1983

[51] Int. Cl.[3] ..... F01L 1/34

[52] U.S. Cl. ..... 123/90.16

[58] Field of Search ..... 123/90.16

[56] References Cited

U.S. PATENT DOCUMENTS

| | | | |
|---|---|---|---|
| 2,410,660 | 11/1946 | Howard | 123/90.16 |
| 2,934,052 | 4/1960 | Longenecker | 123/90.16 |
| 2,954,017 | 9/1960 | Forstner | 123/90.16 |
| 3,157,166 | 11/1964 | MacNeill | 123/90.16 |
| 3,563,214 | 2/1971 | Medenus | 123/90.44 X |
| 4,414,931 | 11/1983 | Burandt | 123/90.44 X |
| 4,429,853 | 2/1984 | Chaffiotte et al. | 123/90.16 X |

FOREIGN PATENT DOCUMENTS

| | | | |
|---|---|---|---|
| 2256185 | 11/1972 | Fed. Rep. of Germany | 123/90.16 |
| 148910 | 11/1980 | Japan | 123/90.16 |

*Primary Examiner*—Michael Koczo
*Assistant Examiner*—Peggy A. Neils
*Attorney, Agent, or Firm*—Stuart R. Peterson

[57] ABSTRACT

The valve operating mechanism includes an L-shaped rocker arm having a cam follower surface on one leg composed of a straight section and a curved section acted upon by a cam on a rotatable camshaft. The other leg of the L-shaped rocker arm contacts a valve member to open the valve member, overcoming the spring closing force to do so. A lever arm has one end mounted for pivotal movement about a shaft providing a fixed axis, a pin carried by said lever arm intermediate said one end and the other end thereof providing a shiftable axis. A base circle feature is included by means of a pair of curved edges adjacent opposite sides of said straight section. The curved section provides an increased amount of valve opening, the curved section curving sufficiently to provide a semi-desmodromic valve operation desirable during maximum valve lift at high engine speeds.

25 Claims, 6 Drawing Figures

MECHANISM FOR VARIABLY CONTROLLING AN INTERNAL COMBUSTION ENGINE VALVE

CROSS-REFERENCE TO RELATED APPLICATIONS

My co-pending U.S. applications titled "VARIABLE VALVE OPERATING MECHANISM FOR INTERNAL COMBUSTION ENGINES", Ser. No. 310,655 filed on Oct. 13, 1981, now U.S. Pat. No. 4,414,931, issued on Sept. 6, 1983, and "APPARATUS UTILIZING A PLURAL-PROFILED CAM UNIT FOR ACTUATING THE VALVE OF AN INTERNAL COMBUSTION ENGINE", Ser. No. 378,842 filed on May 17, 1982 contain subject matter generally related to this application.

BACKGROUND OF THE INVENTION

1. Field of the Invention

This invention relates generally to internal combustion engines, and pertains more particularly to a mechanism for variably controlling both the lift and duration of the engine's valves.

2. Description of the Prior Art

Various mechanisms have been devised for controlling the opening and closing of the inlet and exhaust valves associated with internal combustion engines. As pointed out in my said co-pending applications, those known to me have possessed various shortcomings, such as being capable of controlling only valve lift or valve duration, but not both. Even so, most of the mechanisms with which I am acquainted cause an appreciable amount of friction. Some have the additional disadvantage of being quite massive, involving a considerable amount of inertia, and occupying more space than desirable. Others are quite complicated and costly to manufacture, thereby discouraging their adoption.

SUMMARY OF THE INVENTION

One object of my invention is to provide a valve operating mechanism that will control either the intake or exhaust valves of an internal combustion engine, controlling both the lift and duration, but doing so in a simple and straightforward manner. In this regard, an aim of the invention is to accomplish the control with a minimum number of parts, thereby reducing both the cost and inertia of the valve control mechanism.

An important object is to reduce appreciably the friction that has heretofore been experienced with various valve control mechanisms, thereby minimizing both wear and maintenance, as well as reducing the power required to operate the valve in each instance where my mechanism is employed.

Another object of the invention is to provide a control mechanism for valves that will be quite small in size, thus enhancing its use with engines for powering compact cars where the space beneath the hood is at a premium.

Yet another object of the invention is to provide a valve control mechanism that will permit easy access to lash caps or to permit other means of adjusting valve lash.

Still another object of the invention is to provide an optional means of adjusting valve lift independently of any lash adjustment.

A further and important object is to reduce mechanical stresses in the valve linkage, thereby enabling higher engine speeds to be employed. It is also an aim of the invention to concomitantly reduce valve spring pressures. Stated somewhat differently, it is a desideratum of the invention to permit a semi-desmodromic valve operation to be achieved, an operation not heretofore feasible.

The invention has for still another object the provision of a separate and distinct valve operating mechanism for each valve of an internal combustion engine, such mechanism being capable of being independently adjusted relative to the others, thereby enabling the amount of valve movement for each valve to be individually obtained.

Briefly, my invention comprises a single L-shaped rocker arm having a vertical leg formed with a cam follower surface that is engageable with a conventional cam mounted on the engine's camshaft, the cam follower surface including a linear section and a nonlinear section. The rocker arm has a horizontal leg that is engageable with the upper end, more specifically, the tappet or lash cap, of the valve member to be actuated. A lever arm is pivotally mounted at one end to a shaft that provides a fixed axis, and a shiftable axis is provided by means of a pin spaced from the fixed axis, the pin extending transversely through the vertical leg of the rocker arm. The free end of the horizontal leg, the free end having a depending nose thereon that actually engages the valve member, functions as a contact point. The vertical leg is raised and lowered by a suitable actuating device, such as via an accelerator pedal and hydraulic amplifier associated therewith, so as to cause desired portions of the linear and nonlinear follower sections on the vertical leg to be presented to the rotatable cam with which the rocker arm coacts. Depending upon the profile of the cam follower surface, the lift and duration of the valve opening can be adjusted by merely raising or lowering the vertical leg of the rocker arm. The profile of the nonlinear cam follower section can be contoured so as to permit a lighter weight valve spring to be employed; this achievable action is herein referred to as a semi-desmodromic valve operation. Adjacent the linear cam follower section are two additional surfaces or edges that function in a base circle capacity, being engageable with the eccentric take-up portions on the camshaft at opposite sides of the cam mounted thereon.

DESCRIPTION OF THE PREFERRED EMBODIMENT

Figure 1:
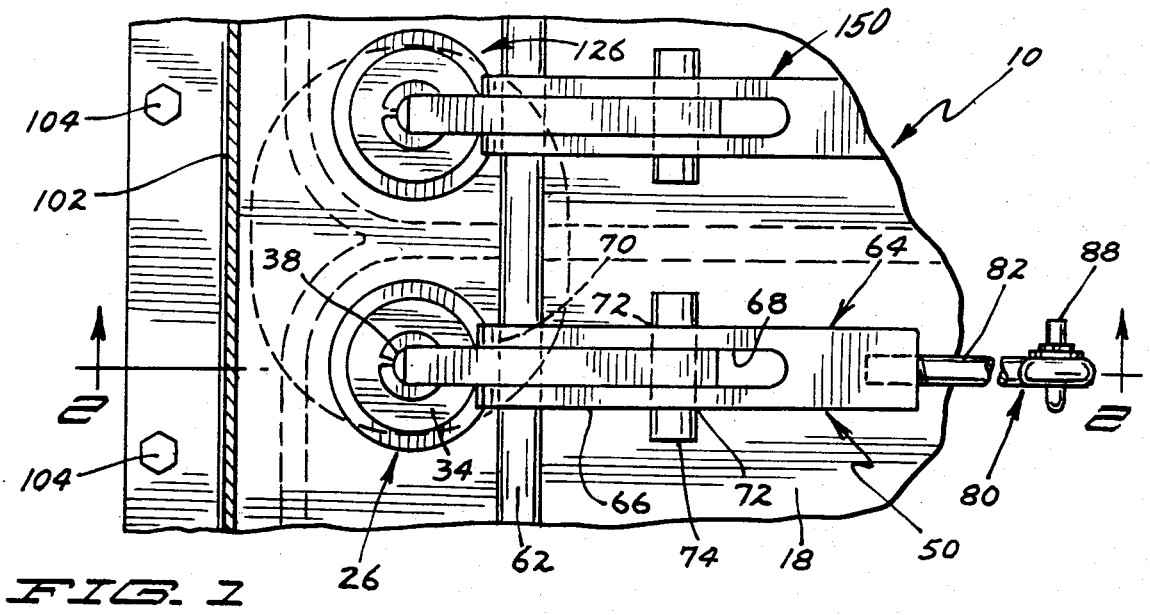
FIG. 1 is a top plan view of two control mechanisms exemplifying my invention, one mechanism being associated with the intake valve of an internal combustion engine's cylinder and the other with the exhaust valve of such cylinder.

Referring to the drawings, a conventional internal combustion engine 10 has been fragmentarily illustrated. The engine 10 includes an engine block 12 containing a combustion cylinder or chamber 14 therein, being but one of any number of cylinders. Within the combustion chamber 14 is a reciprocable piston 16, a portion thereof appearing in FIG. 5 only. Being conventionally reciprocated, it is not thought necessary to illustrate the piston rod and crankshaft. Overlying the cylinder block 12 and secured thereto is a cylinder head 18.

It will be discerned that there is a valve port 20 formed in the lower side of the cylinder head by reason of a downwardly facing beveled seat 22. The valve port 20 constitutes an intake opening, a passage 24 extending to the opening or port 20 from the intake manifold (not shown) of the engine 10.

Also conventionally included is a reciprocating intake valve 26 having a valve head 28 at its lower end, the valve head 26 being beveled at 30 so as to seat against the beveled seat 22. Extending upwardly from the head 28 is a stem 32. Formed in the upper end portion of the stem 32 is an annular groove for anchoring a washer-like retainer 34. A coil spring 36 acts against the retainer 34 to normally urge the vertically reciprocable valve 26 into its closed position, this position appearing in the solid line position of FIGS. 2 and 3. The upper end of the valve stem 32 has been denoted by the reference numeral 38.

Obviously, each cylinder or combustion chamber would also have an exhaust valve associated therewith, and for the sake of completeness an exhaust valve is shown at 126 in FIG. 1. It is not thought necessary, however, to further refer to the valve 126 other than to mention that its construction is similar to the valve 26; only the function is different.

A camshaft 40 having a cam 42 thereon is journaled for rotation in bearing plates, one of which plates appears at 46 in the drawings. There are, of course, an appropriate number of bearing plates 46 so that the camshaft 40 is adequately supported for rotation throughout its length. The various plates 46 are suitably attached to the cylinder head 18. The camshaft 40, it will be understood, is driven from the engine 10, having whatever number of cams 42 thereon that are needed for the number of cylinders or combustion chambers 14 that the particular engine 10 has. Only one such cam 42 need be shown in order to illustrate my invention, however.

Although shown and described more fully in my said co-pending application, Ser. No. 378,842, reference will now be made to an eccentric portion 44 that is adjacent the cam 42. Actually, there are two eccentric portions 44, one to either side of the cam 42. In this regard, it will be appreciated that the cylindrical surface of the camshaft 40 constitutes a base circle, the portions 44, owing to their increasing radius functioning as take-up ramps, coacting with curved edges yet to be described.

At this time, though, reference will be made to my valve operating mechanism, the valve operating mechanism being denoted generally by the reference numeral 50. The valve mechanism 50 comprises an L-shaped rocker arm 52 having a vertical leg 54 and a horizontal leg 56.

Describing in detail the vertical leg 54 of the rocker arm 52, it is to be observed that it has formed thereon a cam follower surface 58 having a linear or straight lower section **58*a* and a nonlinear or curved upper section 58*b*. The cam follower surface 58, it will be understood, is intended to be engaged and acted on by the previously mentioned cam 42. Flanking the straight section 58*a* of the cam follower surface 58 are curved edges 58*c* providing surfaces that are intended to be engageable with the cylindrical surface or base circle portion of the camshaft 40 and the eccentric take-up ramp portions 44 axially adjacent the cam 42**.

The horizontal leg 56 of the rocker arm 52 is considerably simpler as far as its shape is concerned than is the vertical leg 54. More specifically, though, the horizontal leg 56 has a downwardly depending nose or nub 60 that bears against the upper end 38 of the valve stem 32. Owing to the construction of my mechanism 50, the nose 60 serves as a contact point resulting in very little rubbing of the nose 60 against the upper end 38 during actuation of the valve 26, as will become clear hereinafter.

Describing now the manner in which the rocker arm 52 is mounted, attention is first directed to a shaft 62 providing a fixed axis, the shaft 62 being held by means of two of the bearing plates 46 that are fixedly attached to the cylinder head 18, as earlier mentioned. Pivotally mounted on the shaft 62 is a lever arm 64, the lever arm 64 having a bifurcated or clevis portion 66 (see FIG. 1) that receives an intermediate portion of the vertical leg 54 of the rocker arm 52 therein. In other words, there is a slot 68 formed in the lever arm 64 that accommodates therein the intermediate portion of the vertical leg 54 of the rocker arm 52. The bifurcated end 66 of the lever arm 64 has holes 70 therein that encircle the shaft 62. Intermediate the ends of the lever arm 64 are additional holes 72, these holes 72 also leading into the slot 68 forming the clevis portion 66. The last-mentioned holes receive therein a pin 74 that extends through a hole (not visible) formed in the vertical leg 54 of the rocker arm 52, thereby supporting the rocker arm 52 for rocking movement. More specifically, when the lever arm 64 is actuated in a clockwise direction, the vertical leg 54 of the rocker arm 52 is moved downwardly so as to present various portions of the cam follower surface 58 to the cam 42 as it rotates. By the same token, when the lever arm 64 is moved farther downwardly, another portion of the cam follower surface 58 is brought into juxtaposition with the cam 42.

Although other devices can be employed, for the sake of completeness a device indicated generally by the reference numeral 80 is employed for positioning the lever arm 64, and in turn the vertical leg 54 of the rocker arm 56 to produce an optimum relationship with the cam 42 so that the cam 42 acts on the most appropriate portion of the cam follower surface 58 for the particular load to which the engine 10 is subjected. The device 80 illustratively includes a horizontal rod 82 extending from the right end of the lever arm 64 as viewed in FIG. 2, the free end of the extension rod 82 having an eye 84 formed thereon. A vertical rod 86 extends downwardly from the rod 82, the rod 86 having a hook 88 at its upper end that engages the eye 84. A hydraulic amplifier or servomechanism 92, through a link 94, augments the force applied to an accelerator pedal 96. The accelerator pedal 96 is pivotally mounted at 98 to the floorboard of the vehicle having the engine 10 therein, a spring 100 biasing the pedal 96 upwardly and away from the floorboard.

It is intended that there be one of my mechanisms 50 associated with each valve of an internal combustion engine, particularly each intake valve, such as the intake valve 26. Inasmuch as an exhaust valve 126 appears in FIG. 1, the control mechanism therefor has been labeled 150. The mechanism 150 is virtually identical to the mechanism 50, differing mainly in the profile of the cam follower surface 58. Whether associated with an intake valve or an exhaust valve, the amount of valve movement, when practicing the teachings of my invention, can be individually determined for each valve in that a separate mechanism 50 (or 150) is employed for each valve.

While not important to my invention, it will be noted that valve cover 102 has been fragmentarily shown in the drawings. The valve cover 102 is held to the upper side of the cylinder head 18 by means of bolts 104.

Having presented the foregoing description, the operation of my mechanism 50 should be readily understandable. Nonetheless, a brief explanation should enable one to appreciate the various benefits to be derived from a practicing of the invention.

Figure 2:
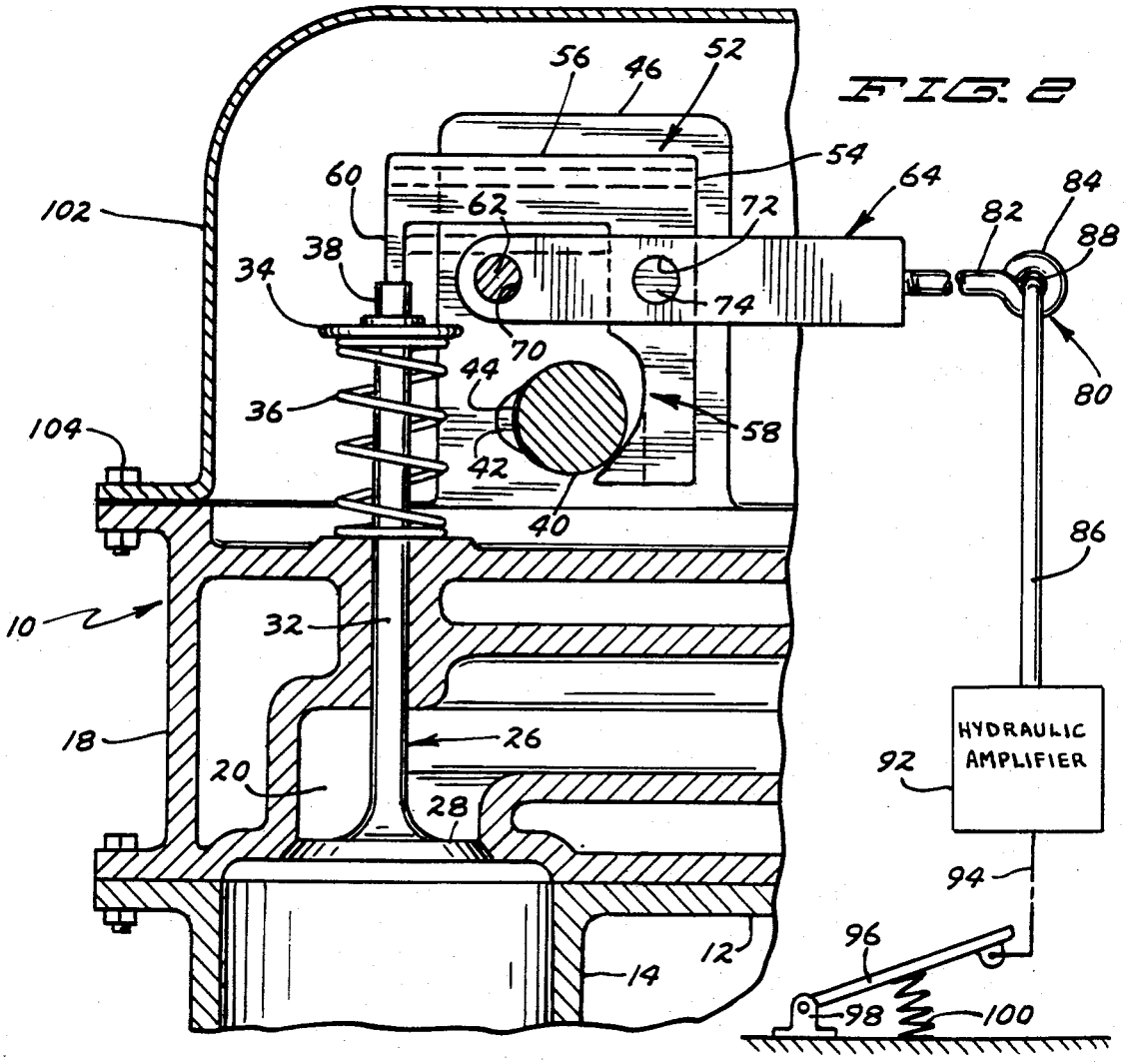
FIG. 2 is a vertical sectional view taken in the direction of line 2—2 of FIG. 1 to illustrate the mechanism associated with the intake valve, the view showing the cam at the 9:00 o'clock position and the valve closed.

FIG. 2 shows the cam 42 in a 9:00 o'clock position. Thus, the cam 42, when in this angular position, is not acting on any portion of the cam follower surface 58; consequently, the valve member 26 by reason of the spring 36 is closed, the spring 36 biasing the head 28 upwardly so that it seats against the beveled seat 22.

Inspection of FIG. 2 will reveal that the cured edges 58*c* are closely adjacent the cylindrical portion of the camshaft 40 in that the eccentric ramp portions 44 are ineffectual when in the angular position in which they appear in FIG. 2.

Figure 3:
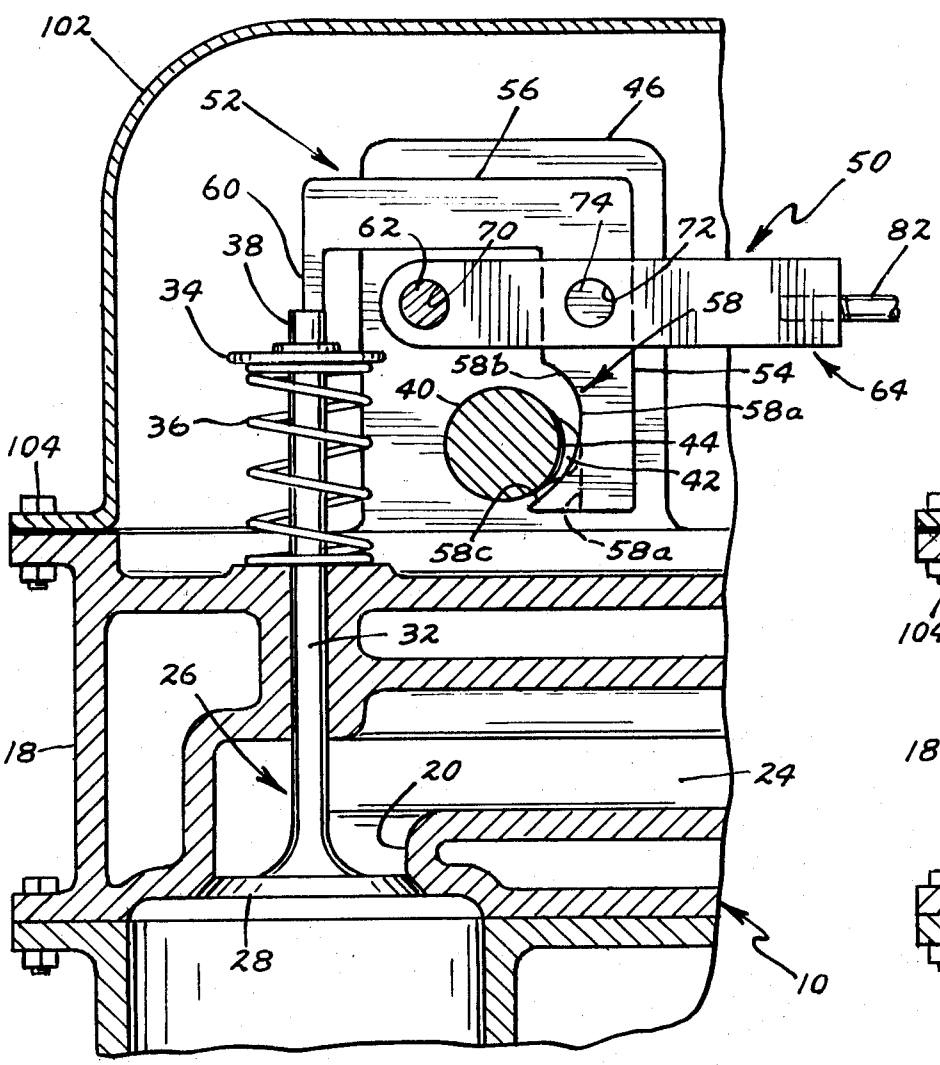
FIG. 3 is a view corresponding to FIG. 2, but with the cam rotated from the 9:00 o'clock position to the 3:00 o'clock position, the valve still being also closed in this view due to the position of the rocker arm and the cam follower surface thereon.

However, as the camshaft 40 rotates in a counterclockwise direction to move the cam 42 into the 3:00 o'clock position shown in FIG. 3, the eccentric ramp portions pass the lower ends of the curved edges 58*c*, assuming that the lash cap 38 has been properly adjusted on the upper end of the valve stem 32, the positions 44 merely graze the curved edges 58*c* in that adjustment of the lash cap 38 is such as to eliminate any clearance that might otherwise exist between the portions 44 and the edges 58*c*.

Even though the cam 42 rotates into the 3:00 o'clock position of FIG. 3, it will be presumed that the engine 10 is at this moment to operating at no load. My mechanism 50 enables the inlet valve 26 to remain closed, for a charge of air and fuel is not needed under these conditions and indeed would be wasted if admitted into the cylinder or combustion chamber 14.

To keep the valve member 26 closed under no load, the lever arm 64 is simply pivoted upwardly in a counterclockwise direction by the device 80, doing so about the fixed axis provided by the shaft 62. This lifts the vertical leg 54 of the rocker arm 52 so as to align a lower portion of the straight section 58*a* with the cam 42 as it passes by, but not to cause any pressural engagement between the cam 42 and the lower portion of the straight section 58*a*. Hence, the valve 26 is not forced open at this time, because the rocker arm is raised so as to align just a lower portion of the straight section of the cam follower surface with the rotating cam. However, in this particular view, the cam is not yet engaging a higher portion of the straight section so as the reciprocable valve remains closed. This is the condition pictured in FIG. 3.

Figure 4:
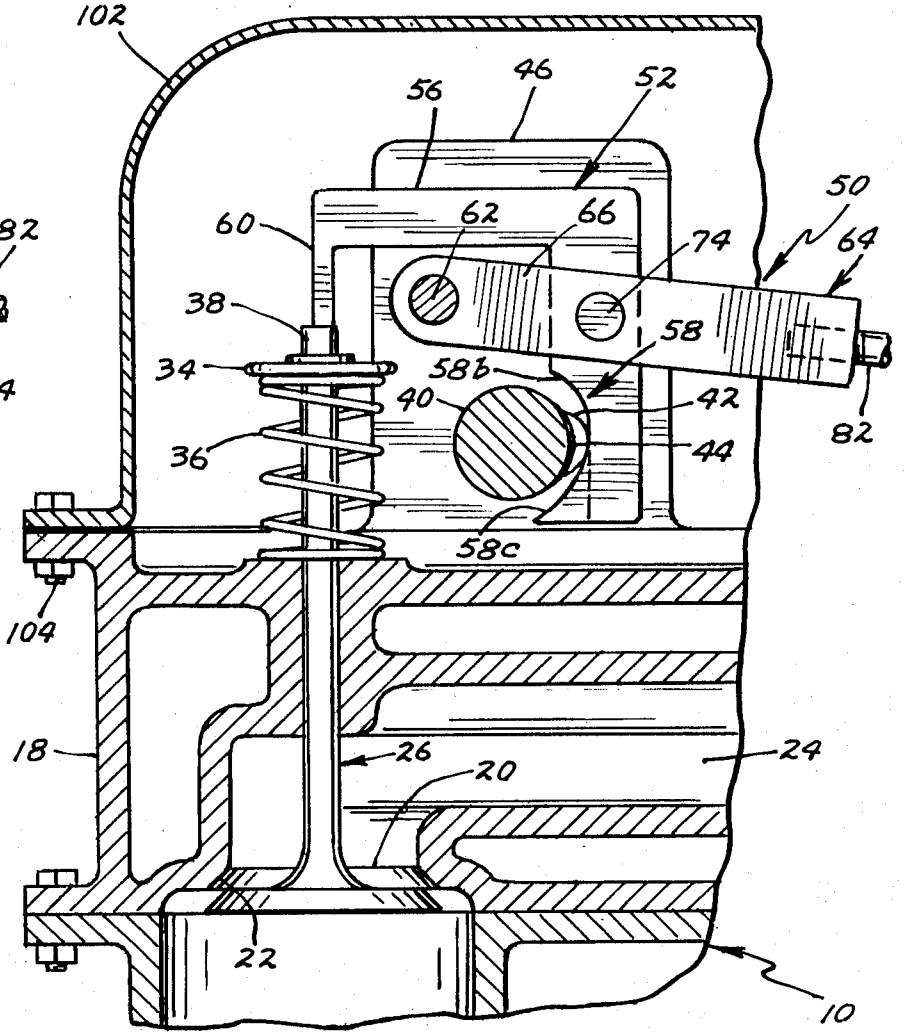
FIG. 4 is a view similar to FIG. 3 but with the valve opened somewhat due to a change in rocker arm position.

Inasmuch as FIG. 4 illustrates a light load condition, it will be appreciated that when the cam 42 rotates into engagement with a higher portion of the straight section 58*a*, there is a slight actuation or rocking of the rocker arm 52 by virtue of the cam 42 engaging this somewhat higher lower portion of the straight section 58*a*, or even a portion of the curved section 58*b* whichcontinues upwardly from the upper end of the straight section 58*a*. Thus, as the cam rotates upwardly as viewed in FIG. 4, that is, in a counterclockwise direction, the cam actually engages a higher portion of the straight section in contradistinction to what occurs in FIG. 3. This causes the rocker arm 52 to rock in a counterclockwise direction about the shaft 62 so as to cause the nose 60 at the free end of the horizontal leg 56 to move downwardly, thereby acting against the tappet or lash cap 38 to force the valve member 26 downwardly into the open position appearing in FIG. 4. It will be appreciated that the device 80 angularly positions the lever arm 64 to achieve this result.

Assuming now that the load on the engine 10 has increased and that the valve 26 should open to a greater extent, the rocker arm 52 is rocked by means of the control or actuating device 80 so as to pull the curved section 58*b* downwardly into juxtaposition with the rotating cam 42. See FIG. 5. Consequently, when the cam 42 engages the curved section 58*b*, it causes the rocker arm 52 to rotate or rock to a greater degree in a counterclockwise direction inasmuch as the cam 42, under these circumstances, forces the vertical leg 54 farther outwardly or farther to the right with the result that the horizontal 56 leg, more specifically, the nose 60 carried thereon, moves downwardly to a greater extent, thereby causing the valve 26 to open to a greater degree in FIG. 5 than happens in FIG. 4.

With the foregoing details in mind, the manner in which my mechanism can achieve a semi-desmodromic valve operation will be better appreciated. First, though, it should be recognized that the primary need for desmodromic operation exists only during a small portion of the valve event at a condition of high valve lift and high engine RPM.

The period of initial valve opening is positive, and assuming that there is no braking or slowing down of the engine 10, it should be apparent that the operation of the valve 26 cannot be permitted to lag behind that of the cam 42. At the period of maximum valve lift, it is possible that the inertia forces of the valve 26, and whatever prior art valve operating mechanism is employed, will exceed the return or closing capabilities of the valve spring, such as the spring 36.

It is during the above critical period that control of the valve 26 and the valve operating mechanism is lost. The time required for the valve spring, such as the spring 36, to overcome the valve mechanism inertia may take longer than the valve closing event, thus resulting in very high impact, and possible bouncing, of the valve head 28 against the seat 22.

Figure 5:
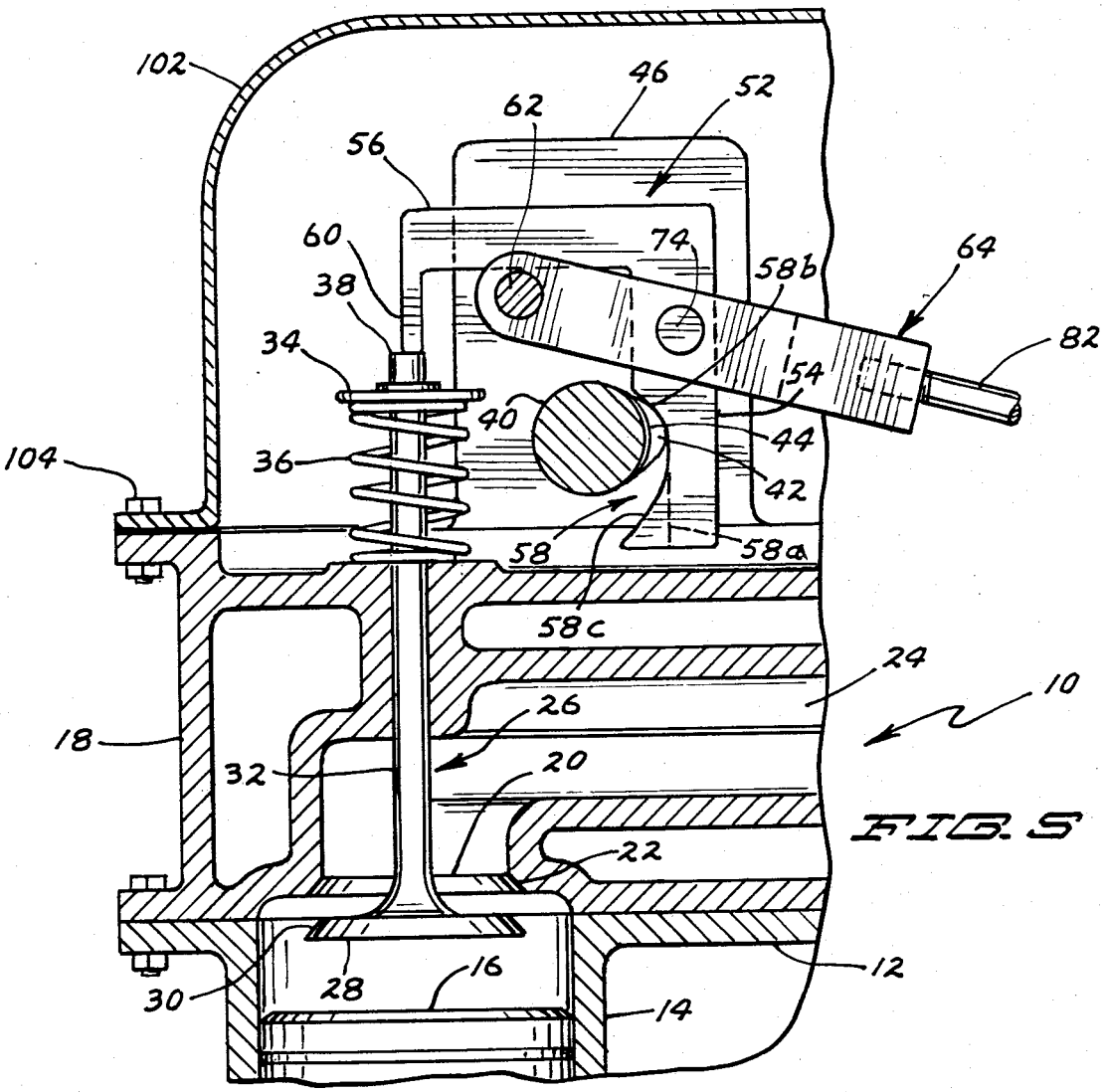
FIG. 5 is a view similar to FIG. 4, but with a valve opened to a greater degree due to a further change in rocker arm position.
Figure 6:
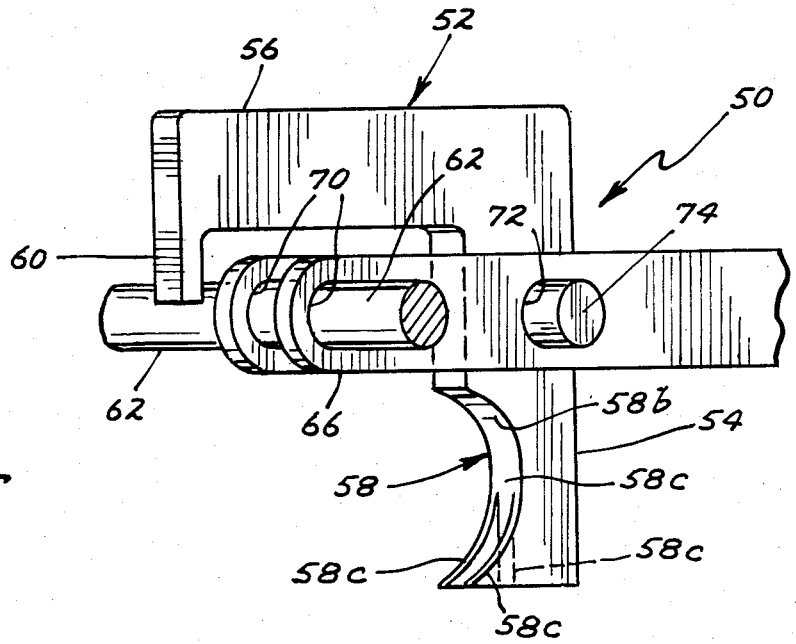
FIG. 6 is a perspective view of my valve control mechanism devoid of the engine parts shown in FIGS. 1–5.

Close study of FIG. 5 will reveal that the upper end of the curved section 58*b* on the leg 54 of the rocker arm 52 terminates on approximately a line extending between the centerline of the camshaft 40 and the pin 74. The curved section 58*b* constitutes what might be termed a desmodromic "hook". Whereas the cam 42, as it moves upwardly to an angular position coinciding with the centers of the camshaft 40 and the pin 74, that is, to the 1:30 o'clock position, the cam 42 continues to exert a positive force on the leg 54 of the rocker arm 52, doing so in a direction to cause the rocker arm to rock in a counterclockwise direction to open the valve 26. Where the curvature of the section 58*b* continues sufficiently beyond the 1:30 o'clock position, and with the proper contour or profile imparted thereto, a positive force continues to be exerted on the leg 54 of the rocker arm 52, but under these conditions to rock the rocker arm 52 in an opposite or clockwise direction. Whereas a counterclockwise pivoting or rocking of the rocker arm 52 is in a direction to open the valve 26, a clockwise pivoting or rocking of the rocker arm is in a direction to allow the valve 26 to close. Hence, the degree of extent of "hook" is instrumental in relieving the spring 36 of having to supply the full amount of valve closing force. In other words, any tendency for the valve 26 to remain open or to continue to open under maximum lift and high engine speeds is checked. The contour of the curved section 58*b* is merely a matter of degree, depending upon two factors: amount of maximum valve opening or lift as correlated with high engine RPM. In other words, the inertia effect of the rocker arm 52 is removed since the valve 26 is free to move in a closing direction by means of the curved section 58*b*. The need for desmodromic valve operation is not always required, but it is present when needed, my mechanism having this highly desirable performance capability when a sufficient hook-like curvature is imparted to the section 58*b*.

As far as the drawing is concerned, it is believed that the relation depicted in FIG. 5 is adequate to demonstrate the semi-desmodromic action that can be achieved under heavy load and high speed operating conditions.

Still further, it should be readily appreciated that the lift or amount of valve opening can be changed. It should also be appreciated that the profile of the cam follower surface 58 can be changed so as to change the duration of the valve opening as well. To increase the duration, all that need be done is to have the curvature of the section 58*b* begin at a lower point on the vertical leg 54 and have the curvature continue over a greater arc. If the duration is to be shortened, then just the converse of the foregoing is necessary, for then the curved section 58*b* would be in engagement with the cam 42 through a lesser angle. In this way, it should be appreciated that both the lift and duration can be controlled once a particular profile for the cam follower surface 58 is decided upon.

The degree of lash take-up control is an exceedingly desirable feature. It is thought that this feature has been sufficiently portrayed herein. However, as already explained one can resort to my said co-pending application, Ser. No. 378,842 for additional details if needed. Basically, the ramp portions 44 touch the curved edges 58*c* to eliminate lash, the cam 42 then acting on whatever portion of the cam follower surface 58 is presented to open the valve 26.

Also, owing to the fact that the valve 26 can remain completely closed under no load conditions (FIG. 3) and only slightly open (FIG. 4) under light load conditions, yet opened completely (nearly completely open in FIG. 5), an appreciable saving in fuel consumption can be realized when practicing my invention. Furthermore, the mechanism 50, as should now be recognized, is of simple and low cost construction.

I claim:

1. A mechanism for operating a valve of an internal combustion engine having a rotatable camshaft, a can on said camshaft, a combustion chamber and a reciprocable valve member for opening and closing a valve port in communication with the combustion chamber, the mechanism comprising a rocker arm having first and second angularly disposed and integrally connected legs, said first leg having a cam follower surface thereon extending in the same general direction that said valve member reciprocates, means mounting said rocker arm for rocking movement about a first axis, and means for shifting said first axis relative to said camshaft in also the same general direction said valve member reciprocates so that various portions of the cam follower surface on said first leg are relatively engageable with said cam, and said second leg includes a single portion thereof engaging said valve member so that only said single portion acts on said valve member.

2. A mechanism in accordance with claim 1 in which said various portions of the cam follower surface on said first leg include first and second sections having different profiles engageable with said cam as said camshaft rotates.

3. A mechanism in accordance with claim 2 in which said first section is linear and said section is nonlinear, said linear and nonlinear sections providing said various portions.

4. A mechanism in accordance with claim 3 in which said single portion constitutes the free end of said second leg and said free end continually engages said valve member, said free end serving as a continuous contact point for said rocker arm when said first axis is shifted.

5. A mechanism in accordance with claim 4 in which said means for shifting said first axis shifts said first axis about a second axis.

6. A mechanism in accordance with claim 5 in which said second axis is fixed and the distance between said first and second axes is also fixed.

7. A mechanism in accordance with claim 6 in which said second axis is intermediate said first axis and said free end.

8. A mechanism in accordance with claim 7 in which said first axis intersects said first leg between the cam follower surface and the juncture is where said legs are integrally connected.

9. A mechanism for operating a valve of an internal combustion engine having a rotatable camshaft, a cam on said camshaft, a combustion chamber and a reciprocable valve member for opening and closing a valve port in communication with the combustion chamber, the mechanism comprising a rocker arm having first and second angularly disposed and integrally connected legs, said first leg having a cam follower surface thereon including a first linear section and a second nonlinear section, means mounting said rocker arm for rocking movement about a first axis, and means for shifting said first axis relative to said camshaft so that various portions of the cam follower surface on said first leg are relatively engageable with said cam, said linear and nonlinear sections providing said various portions, said second leg including a single portion thereof engaging said valve member so that only said single portion acts on said valve member, and an eccentric ramp portion on said camshaft adjacent one side of said cam, said first leg having a nonlinear edge adjacent one side of said linear section, said nonlinear edge being engageable with said eccentric ramp portion.

10. A mechanism in accordance with claim 9 including an additional eccentric ramp portion adjacent the other side of said cam, said first leg having an additional nonlinear edge adjacent the other side of said linear section, said additional nonlinear edge being engageable with said additional ramp portion.

11. A mechanism for operating a valve of an internal combustion engine having a rotatable camshaft, a cam on said shaft, and a valve member reciprocable along a predetermined path for opening and closing a valve port in communication with a combustion chamber of the engine, the mechanism comprising a shaft providing a fixed axis, a lever arm pivotally connected to said shaft, a one-piece L-shaped rocker arm pivotally carried on said lever arm at a location spaced from said shaft, and said rocker arm having only one end thereof engageable with said valve member and said one end traversing a path generally corresponding to said predetermined path, said rocker arm having a first cam follower surface engageable with said cam, and means for pivotally actuating said lever arm to rock said rocker arm about its said one end and thereby shift said cam follower surface relative to said cam.

12. A mechanism in accordance with claim 11 in which said lever arm has a slot therein to provide a clevis portion, one end of said clevis portion being pivotally mounted on said shaft, and a pin extending through said clevis portion and a portion of said rocker arm so as to transmit rocking movement from said lever arm to said rocker arm.

13. A mechanism in accordance with claim 11 in which said cam follower surface includes a straight section and a curved section.

14. A mechanism in accordance with claim 13 including a spring for closing said valve member and in which said curved section curves in a direction toward said valve member.

15. A mechanism in accordance with claim 13 including curved edges to either side of said straight section, said camshaft having eccentric ramp portions axially adjacent said cam for acting against said curved edges.

16. In combination with an internal combustion engine having a rotatable camshaft, a cam on said camshaft, a combustion chamber and a vertically reciprocable valve member associated with said combustion chamber, a mechanism for controlling said valve member comprising a rocker arm including a generally horizontal leg having a predetermined portion thereof engaging the upper end of said valve member and a generally vertical leg having various vertical portions thereof engageable with said cam, and means for raising and lowering said vertical leg to present certain of said various vertical portions thereof for engagement by said cam.

17. The combination of claim 16 in which said various portions provide a cam follower surface composed of a lower straight vertical section and an upper curved section curving upwardly toward said valve member.

18. In combination with an internal combustion engine having a rotatable camshaft, a cam on said camshaft, a combustion chamber and a vertically reciprocable valve member associated with said combustion chamber, a mechanism for controlling said valve member comprising a rocker arm including a generally horizontal leg having a predetermined portion thereof engaging the upper end of said valve member and generally vertical leg having various portions thereof engageable with said cam, said variable portions including a lower straight vertical section and an upper curved section curving upwardly toward said valve member, and means for raising and lowering said vertical leg to present said various portions thereof for engagement by said cam, said means for raising and lowering said vertical leg including a lever arm mounted for pivotal movement about a fixed axis, said vertical leg being pivotally connected to said lever arm.

19. The combination of claim 18 in which said horizontal leg has a downwardly extending nose at the free end thereof, said nose engaging the upper end of said valve member.

20. The combination of claim 19 in which said fixed axis is at one end of said lever arm and said vertical leg is pivotally connected to said lever arm between said one end and the other end thereof for movement about an axis shiftable relative to said fixed axis, and means for moving said other end of the lever arm to present portions of said straight and curved sections to said cam.

21. The combination of claim 20 including a spring for closing said valve member and in which said curved section curves toward said valve member.

22. The combination of claim 20 in which said curved section curves at least to a line extending between the axis of rotation of said camshaft and said shiftable axis.

23. A mechanism in accordance with claim 20 in which said camshaft includes an eccentric ramp portion adjacent said cam, and said vertical leg includes a curved edge adjacent said straight section curving toward said valve member, said curved edge being engageable with said eccentric ramp portion.

24. A mechanism in accordance with claim 23 in which said means for moving the other end of said lever arm includes an accelerator pedal.

25. A mechanism in accordance with claim 24 in which said means for moving the other end of said lever arm also includes a hydraulic amplifier.

* * * * *